US005192195A

United States Patent [19]

Iio et al.

[11] Patent Number: 5,192,195

[45] Date of Patent: Mar. 9, 1993

[54] SCROLL TYPE COMPRESSOR WITH SEPARATE CONTROL BLOCK

[75] Inventors: Takayuki Iio, Nishikasugai; Takahisa Hirano; Yoshiharu Morita, both of Nagoya, all of Japan

[73] Assignee: Mitsubishi Jukogoyo Kabushiki Kaisha, Tokyo, Japan

[21] Appl. No.: 766,403

[22] Filed: Sep. 27, 1991

[30] Foreign Application Priority Data

Nov. 14, 1990 [JP] Japan ..... 2-308193
Nov. 16, 1990 [JP] Japan ..... 2-311082

[51] Int. Cl.[5] ..... F04B 49/00
[52] U.S. Cl. ..... 417/299; 417/310
[58] Field of Search ..... 418/55.1; 417/310, 299

[56] References Cited

U.S. PATENT DOCUMENTS 4,408,964 10/1983 Mochizuki ..... 417/310

FOREIGN PATENT DOCUMENTS 63-212789 9/1988 Japan .
1-106990 4/1989 Japan .

*Primary Examiner*—Richard A. Bertsch
*Assistant Examiner*—Roland McAndrews

[57] ABSTRACT

A scroll type compressor has bypass ports which communicate with the compression chambers. The bypass ports are bored in an end plate of a stationary scroll. A capacity control block is contained inside a bypass passage which has the bypass ports communicate with a suction chamber formed in a housing. A valve mechanism which opens and closes the bypass passage is formed separately from the stationary scroll. The capacity control block is engaged with the stationary scroll and installed fixedly in the housing, thereby to control the output capacity of the compressor in a range from 0% to 100%.

5 Claims, 8 Drawing Sheets

SCROLL TYPE COMPRESSOR WITH SEPARATE CONTROL BLOCK

FIELD OF THE INVENTION AND RELATED ART STATEMENT

The present invention relates to a scroll type compressor which is suitable for an air conditioner for vehicles and the like.

FIG. 8 thru FIG. 10 show an example of a conventional scroll type compressor.

In FIG. 8, a hermetic housing 1 consists of a cup-shaped main body 2, a front end plate 4 fastened thereto with a bolt 3, and a cylindrical member fastened thereto with a bolt 5. A main shaft 7 which penetrates through the cylindrical member 6 is supported rotatably by the housing 1 through bearings 8 and 9.

A stationary scroll 10 is disposed in the housing 1, and the stationary scroll 10 is provided with an end plate 11 and a spiral wrap 12 which is set up on the inner surface thereof, and the end plate 11 is fastened to the cup-shaped main body 2 with a bolt 13, thereby to fix the stationary scroll 10 in the housing 1. The inside of the housing 1 is partitioned by having the outer circumferential surface of the end plate 11 and the inner circumferential surface of the cup-shaped main body 2 come into close contact with each other, thus forming a discharge cavity 31 on the outside of the end plate 11 and delimiting a suction chamber 28 on the inside of the end plate 11.

Further, a discharge port 29 is bored at the center of the end plate 11, and the discharge port 29 is opened and closed by means of a discharge valve 30 which is fastened to the outer surface of the end plate 11 with a bolt 36 together with a retainer 35.

A revolving scroll 14 is provided with an end plate 15 and a spiral wrap 16 which is set up on the inner surface thereof, and the spiral wrap 16 has essentially the same configuration as the spiral wrap 12 of the stationary scroll 10.

The revolving scroll 14 and the stationary scroll 10 are made to be eccentric with respect to each other by a radius of revolution in a solar motion, and are engaged with each other by shifting the angle by 180° as shown in the figure.

Thus, tip seals 17 buried at a point surface of the spiral wrap 12 come into close contact with the inner surface of the end plate 15, and tip seals 18 buried at a point surface of the spiral wrap 16 come into close contact with the inner surface of the end plate 11. The side surfaces of the spiral wraps 12 and 16 come into close contact with each other at points a, b, c and d so as to form a plurality of compression chambers 19*a* and 19*b* which form almost point symmetry with respect to the center of the spiral as shown in FIG. 10.

A drive bushing 21 is engaged rotatably through a bearing 23 inside a cylindrical boss 20 projected at a central part of the outer surface of the end plate 15, and an eccentric pin 25 projected eccentrically at the inner end of the main shaft 7 is inserted rotatably into an eccentric hole 24 bored in the drive bushing 21. Further, a balance weight 27 is fitted to the drive bushing 21.

A mechanism 26 for checking rotation on its own axis which also serves as a thrust bearing is arranged between an outer circumferential edge of the outer surface of the end plate 15 and the inner surface of the front end plate 4.

Now, when the main shaft 7 is rotated, the revolving scroll 14 is driven through a revolution drive mechanism consisting of the eccentric pin 25, the drive bushing 21, the boss 20 and the like, and the revolving scroll 14 revolves in a solar motion on a circular orbit having a radius of revolution in a solar motion, i.e., quantity of eccentricity between the main shaft 7 and the eccentric pin 25 as a radius while being checked to rotate on its axis by means of the mechanism 26 for checking rotation on its axis. Then, linear contact portions a to d between the spiral wraps 12 and 16 move gradually toward the center of the spiral. As a result, the compression chambers 19a and 19b move toward the center of the spiral while reducing volumes thereof.

With the foregoing, gas which has flown into a suction chamber 28 through a suction port not shown is taken into respective compression chambers 19*a* and 19*b* through opening portions at outer circumferential ends of the spiral wraps 12 and 16 and reaches the central part while being compressed. The gas is discharged therefrom to a discharge cavity 31 by pushing a discharge valve 30 open through a discharge port 29, and outflows therefrom through a discharge port not shown.

A pair of cylinders 32*a* and 32*b* one end each of which communicates with the suction chamber 28 are bored and these pair of cylinders 32*a* and 32*b* are positioned on both sides of the discharge port 29 and extend in parallel with each other in the end plate 11 of the stationary scroll 10 as shown in FIG. 9 and FIG. 10. Further, bypass ports 33*a* and 33*b* for bypassing gas during compression to above-mentioned cylinders 32*a* and 32*b* from the inside of the pair of compression chambers 19*a* and 19*b* are bored in the end plate 11. Further, pistons 34*a* and 34*b* for opening and closing the bypass ports 33*a* and 33*b* are inserted in a sealed and slidable manner into these cylinders 32*a* and 32*b*.

When the compressor is in full-load operation, the high pressure control gas generated in a control valve 38 is introduced to respective inner end surfaces of the pistons 34*a* and 34*b* via through holes 39*a* and 39*b*. Then, respective pistons 34*a* and 34*b* are made to advance against resiliency of return springs 41*a* and 41*b* which are interposed in a compressed state between those pistons and spring shoes 40*a* and 40*b*, thereby to block the bypass ports 33*a* and 33*b*.

On the other hand, the pressure of control gas generated from the control valve 38 is decreased when the compressor is in unload operation. Then, respective pistons 34*a* and 34*b* move back by the resiliency of the return springs 41*a* and 41*b* to occupy positions shown in the figure, and the gas which is being compressed passes through the bypass ports 33*a* and 33*b* from the pair of compression chambers 19*a* and 19*b* and outflows into the suction chamber 28 through communication holes 42*a* and 42*b* and blind holes 43*a* and 43*b* bored in the pistons 34*a* and 34*b* and the cylinders 32*a* and 32*b*.

In such a manner, capacity control is made in accordance with the load in the above-described scroll type compressor.

In the above-described conventional compressor, however, the compression chambers 19*a* and 19*b* are formed point-symmetrically with respect to the center of the spiral. Therefore, in order to bypass the gas which is being compressed to the suction chamber 28 side from these compression chambers 19*a* and 19*b*, respectively, it is required to form a pair of bypass ports 33*a* and 33*b* and a pair of cylinders 32*a* and 32*b* in the end plate 11, and to provide two sets of pistons 34*a* and 34*b*, return springs 41*a* and 41*b*, spring shoes 40*a* and 40*b* and the like in these pair of cylinders 32*a* and 32*b*, respectively. Therefore, there has been such problems that the structure becomes complicated, thus increasing the number of parts and the assembly/working mandays and also increasing the cost and the weight.

Moreover, there has been such a drawback that, when the end plate 11 of the stationary scroll 10 is deformed by gas pressure in the compression chambers 19*a* and 19*b* working on the end plate 11, the pistons 34*a* and 34*b* do not slide smoothly.

OBJECT AND SUMMARY OF THE INVENTION

It is an object of the present invention which has been made in view of such circumstances to provide a scroll type compressor for solving the above-described problems, and the gist thereof will be described hereunder.

(1) A scroll type compressor in which a stationary scroll and a revolving scroll formed by setting up spiral wraps on end plates, respectively, are made to engage with each other while shifting the angle so as to form compression chambers, the stationary scroll is installed fixedly in a housing, and the revolving scroll is made to revolve in a solar motion by means of a mechanism for driving revolution while checking rotation on its axis by a mechanism for checking rotation on its axis, thereby to move the compression chambers toward the center of the spiral while reducing volumes thereof so as to compress gas, thus discharging the compressed gas into a discharge cavity formed in the housing through a discharge port provided in the end plate of the stationary scroll, characterized in that bypass ports which communicate with the compression chambers are bored in the end plate of the stationary scroll, a capacity control block contained inside a bypass passage which has the bypass ports communicate with the suction chamber formed in the housing and a valve mechanism which opens and closes the bypass passage is formed separately from the stationary scroll, and the capacity control block is engaged with the stationary scroll and installed fixedly in the housing. (2) A scroll type compressor according to above-described item (1), characterized in that a fitting recessed portion is formed on either one of the outer surface of the end plate of the stationary scroll and the side surface of the capacity control block and a fitting projected portion is formed on the other one thereof, the fitting recessed portion and the fitting projected portion are engaged with each other, and the stationary scroll and the capacity control block are installed fixedly in the housing.

The above described construction being provided in the present invention described in (1) and (2), the inside of the housing is partitioned by a seal member thereby to form a suction chamber and a discharge cavity by having the capacity control block come into close contact with the outer surface of the end plate of the stationary scroll and fastened with a bolt together with the stationary scroll from the outside of the housing. Thus, the bypass ports communicate with the suction chamber through the bypass passage of the capacity control block. The capacity of the compressor is controlled by opening and closing the bypass passage by means of a valve mechanism.

According to the present invention described in (1) and (2), working of the capacity control block and the stationary scroll becomes easy and the cost may be reduced by a large margin because the volume control block is formed separately from the stationary scroll.

Moreover, since the capacity control block is made to come into close contact with the outer surface of the end plate of the stationary scroll and is fastened with a bolt together with the stationary scroll from the outside of the housing, and a seal member which partitions the inside of the housing into the suction chamber and the discharge cavity is interposed between the outer circumferential surface of the capacity control block and the inner circumferential surface of the housing, it becomes easier to incorporate the stationary scroll and the capacity control block into the housing, and the capacity control block is not pressed by external force. Thus, the reliability of the capacity control block may be improved.

(3) A scroll type compressor according to the above-described item (1), characterized in that the capacity control block is made to come into close contact with the outer surface of the end plate of the stationary scroll, and is fixed by fastening with a bolt together with the stationary scroll from the outside of the housing.

(4) A scroll type compressor according to the above-described item (1), characterized in that a seal member which partitions the inside of the housing into the suction chamber and the discharge cavity is interposed between the outer circumferential surface of the capacity control block and the inner circumferential surface of the housing.

The above-described construction being provided in the present invention described in (3) and (4), bypass ports communicating with the compression chambers are connected with the suction chamber in the housing through the bypass passage provided in the capacity control block by engaging the capacity control block with the stationary scroll and installing it fixedly in the housing, and the capacity of the compressor is controlled by opening and closing the bypass passage by means of a valve mechanism.

According to the present invention described in (3) and (4), working of the stationary scroll and the capacity control block becomes easier, the cost may be reduced by a large margin, and it is also possible to incorporate the capacity control block into the housing easily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 1 thru FIG. 7 show a first embodiment of the present invention, wherein:

FIG. 1 is a partial longitudinal sectional view;

FIG. 2 is a perspective view taken along a line II—II in FIG. 1;

FIG. 3 is a sectional view taken along a line III—III in FIG. 6;

FIG. 4 is a view taken along a line IV—IV in FIG. 6;

FIG. 5 is a sectional view taken along a line V—V in FIG. 4;

FIG. 6 is a sectional view taken along a line VI—VI in FIG. 4; and

FIG. 7 is a view taken along a line VII—VII in FIG. 5.

FIG. 8 thru FIG. 10 show an example of a conventional scroll type compressor, wherein:

FIG. 8 is a longitudinal sectional view;

FIG. 9 is a partial sectional view taken along a line IX—IX in FIG. 10; and

FIG. 10 is a cross-sectional view taken along a line X—X in FIG. 8.

DETAILED DESCRIPTION OF A PREFERRED EMBODIMENT

Figure 1:
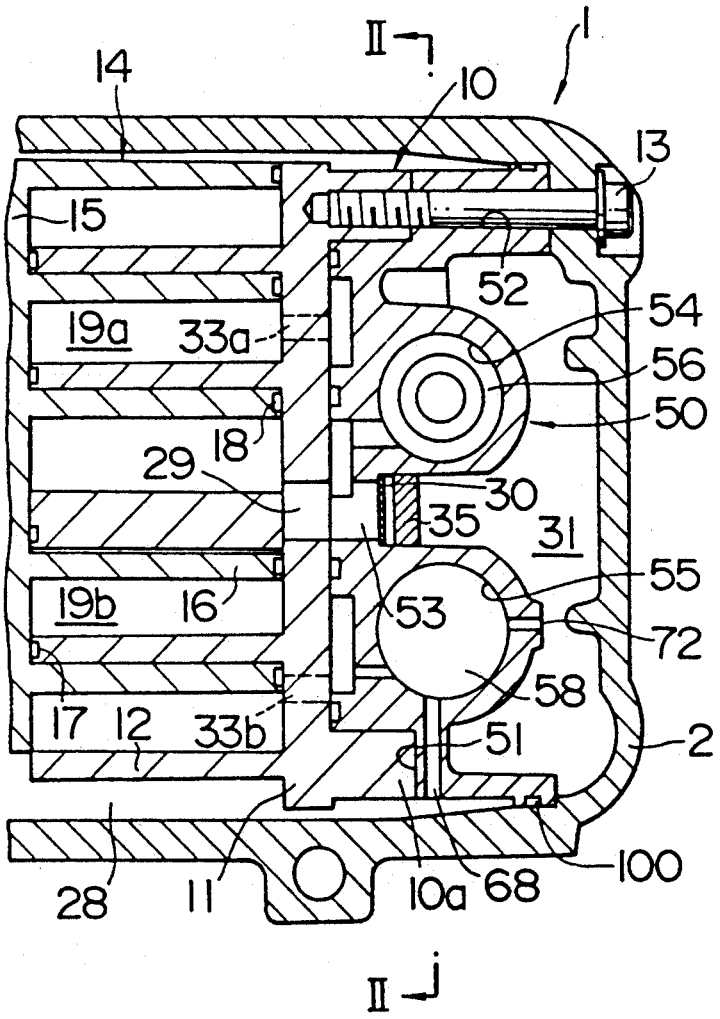
Figure 2:
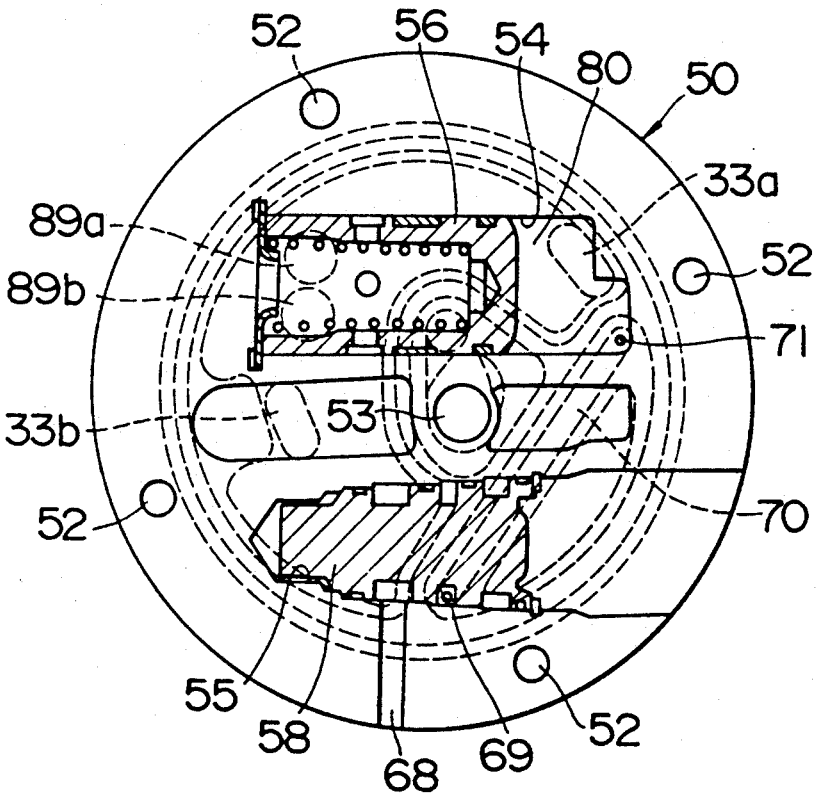
Figure 3:
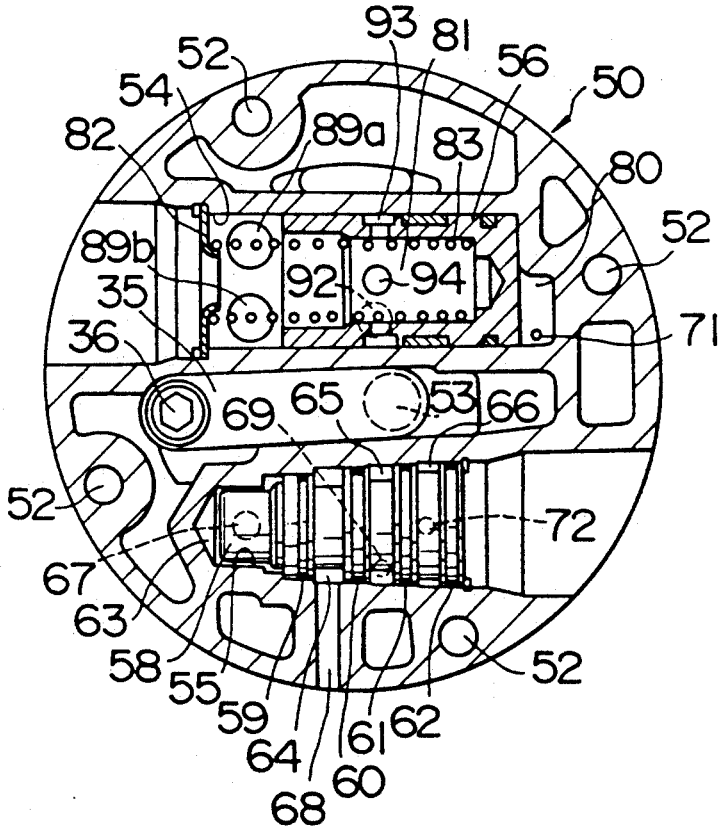
Figure 4:
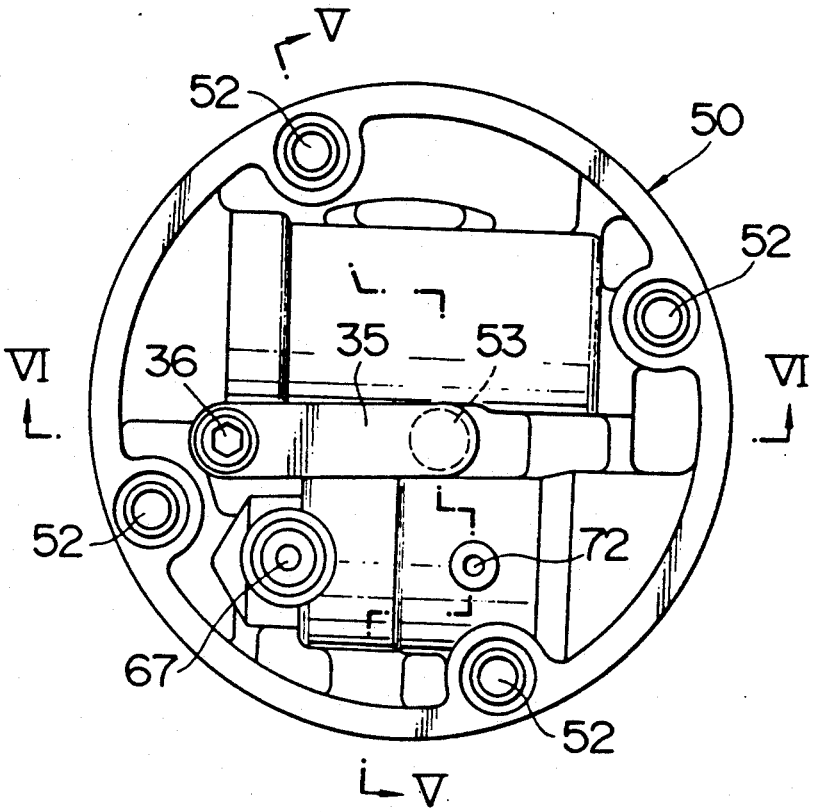
Figure 5:
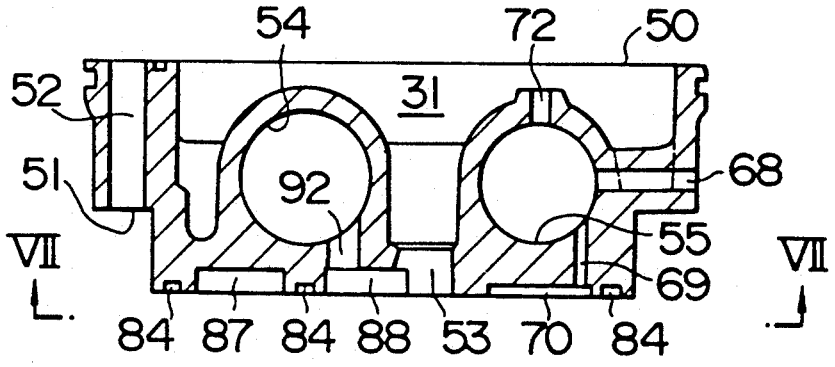
Figure 6:
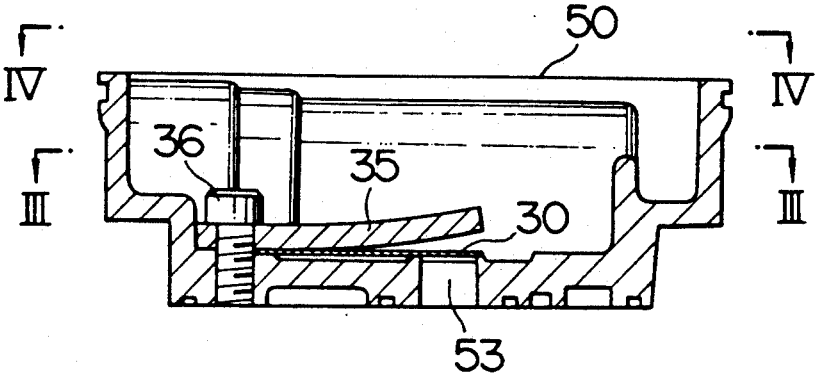

FIG. 1 thru FIG. 7 show an embodiment of the present invention.

A pair of bypass ports 33*a* and 33*b* which communicate with compression chambers 19*a* and 19*b* are bored in an end plate 11 of a stationary scroll 10. A capacity control block 50 is arranged so as to come into close contact with the outer surface of the end plate 11 of the stationary scroll 10. The capacity control block 50 is fixed in a housing 1 together with the stationary scroll 10 by fitting a fitting recessed portion 51 provided thereon to a fitting projected portion 10a provided on the stationary scroll 10, having a bolt 13 pass through a bolt hole 52 bored in the capacity control block 50 from the outside of the housing 1 and screwing the point end thereof into the stationary scroll 10.

Then, the inside of the housing 1 is partitioned into a suction chamber 28 and a discharge cavity 31 by burying a seal member 100 in the rear outer circumferential surface of the capacity control block 50 and having this seal member 100 come into close contact hermetically with an inner circumferential surface of a cup-shaped main body 2.

A discharge hole 53 communicating with a discharge port 29 is bored at the central part of the capacity control block 50, and this discharge hole 53 is opened and closed by means of a discharge valve 30 fastened to the outside surface of the capacity control block 50 with a bolt 36 together with a retainer 35.

A cylinder 54 having a blind hole shape is bored on one side of the discharge hole 53, and a hollow cavity 55 having a blind hole shape is bored in parallel with the cylinder 54 on another side, respectively, and opening ends of the cylinder 54 and the hollow cavity 55 communicate with the suction chamber 28, respectively.

A cup-shaped piston 56 is contained in the cylinder 54 in a sealed and slidable manner, and a control pressure chamber 80 is delimited on one side of the piston 56.and a chamber 81 delimited on another side communicates with the suction chamber 28. Further, this piston 56 is pushed toward the control pressure chamber 80 by a coil spring 83 interposed between the piston 56 and a spring shoe 82. Further, a ring recessed groove 93 bored on the outer circumferential surface of the piston 56 always communicates with the chamber 81 through a plurality of holes 94.

On the other hand, a control valve 58 is fitted into the hollow cavity 55, and an atmospheric pressure chamber 63, a low pressure chamber 64, a control pressure chamber 65 and a high pressure chamber 66 are delimited by partitioning a clearance between the hollow cavity 55 and the control valve 58 with O-rings 59, 60, 61 and 62. Further, the atmospheric pressure chamber 63 communicates with atmospheric air outside the housing 1 through a through hole 67 and a connecting pipe not shown. The low pressure chamber 64 communicates with the suction chamber 28 through a through hole 68, the control pressure chamber 65 communicates with the control pressure chamber 80 through a through hole 69, a recessed groove 70 and a through hole 71, and the high pressure chamber 66 communicates with the discharge cavity 31 through a through hole 72.

Thus, the control valve 58 senses a high pressure HP in the discharge cavity 31 and a low pressure LP in the suction chamber 28, and generates a control pressure AP which is an intermediate pressure of these pressures and may be expressed as a linear function of a low pressure LP.

Figure 7:
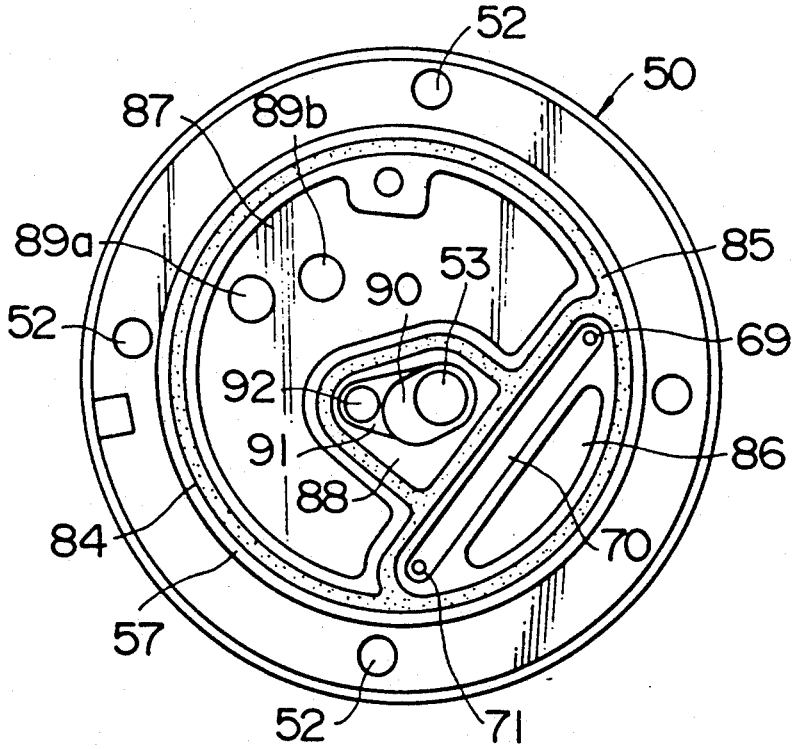

As shown in FIG. 7, recessed grooves 70, 90 and 91, a first recessed portion 86, a second recessed portion 87 and a third recessed portion 88 are bored on the inner surface of the capacity control block 50. A seal material 85 is fitted in a seal groove 84 bored at a land portion 57 surrounding these first, second and third recessed portions 86, 87 and 88. By having this seal material 85 come into close contact with the outer surface of the end plate 11 of the stationary scroll 10, these first, second and third recessed portions 86, 87 and 88 are formed between the capacity control block 50 and the outer surface of the end plate 11, and partitioned by means of the seal material 85. The first recessed portion 86 communicates with the control pressure chambers 65 and 80 through the recessed groove 70 and the through holes 69 and 71, the second recessed portion 87 communicates with compression chambers 19*a* and 19*b* which are being compressed through a pair of bypass ports 33*a* and 33*b* bored in the end plate 11 and communicates also with the chamber 81 of the cylinder 54 via through holes 89*a* and 89*b*, and the third recessed portion 88 communicates with a discharge hole 53 through the recessed grooves 90 and 91 and communicates also with the chamber 81 of the cylinder 54 through a communication hole 92.

Besides, the bypass ports 33*a* and 33*b* are disposed at positions to communicate with the compression chambers 19*a* and 19*b* during the period until the compression chambers enter into a compression process after terminating suction of gas, and the volume thereof is reduced to 50%.

Figure 8:
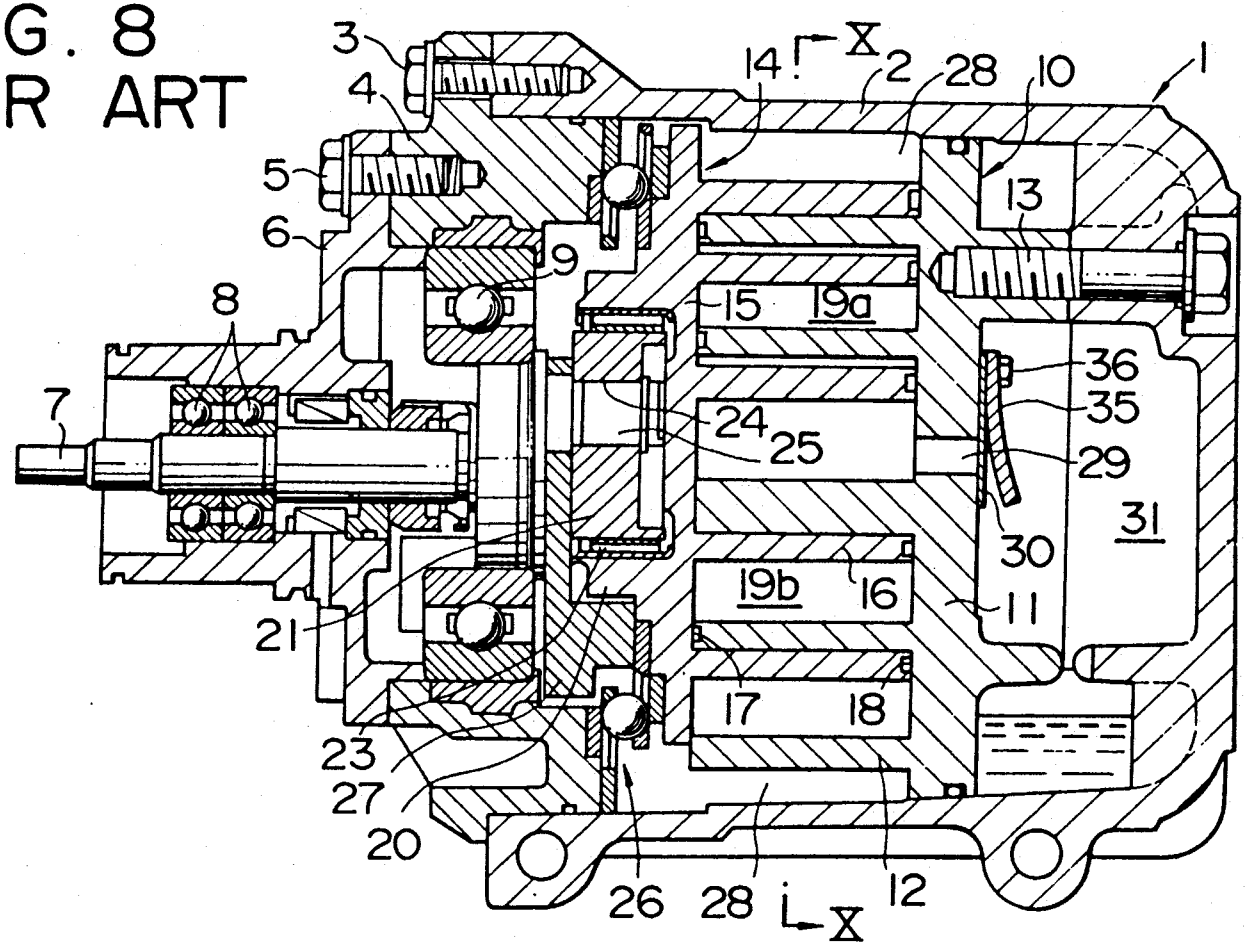
FIG. 8 PRIOR ART
Figure 9:
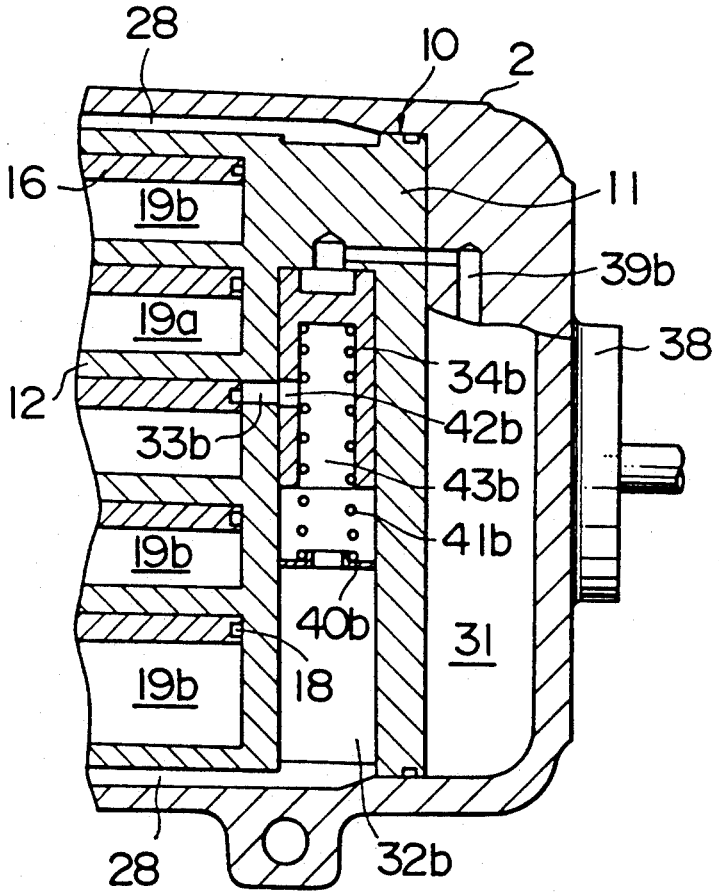
FIG. 9 PRIOR ART
Figure 10:
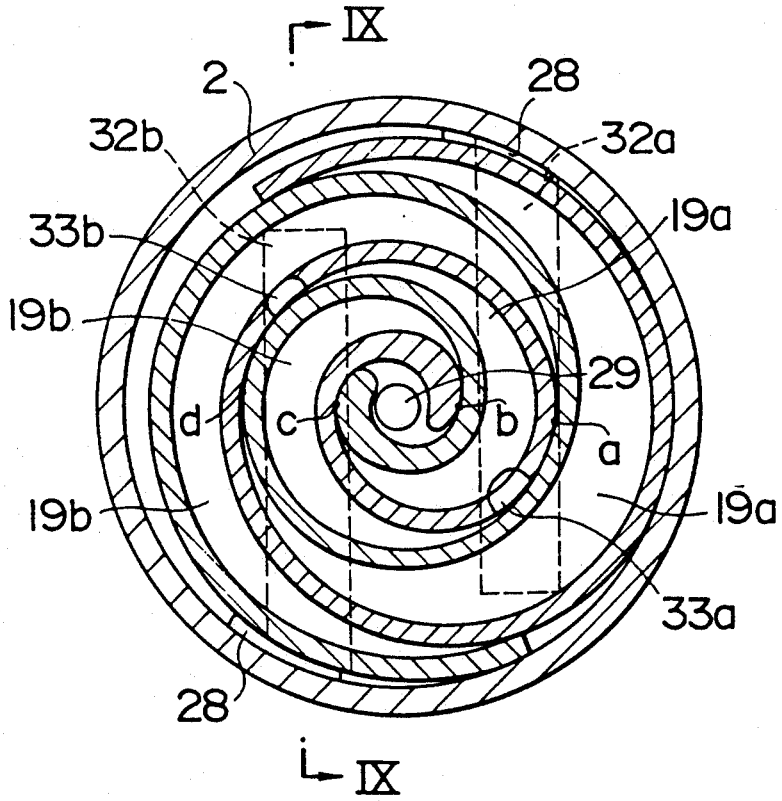
FIG. 10 PRIOR ART

Other construction is the same as that of a conventional apparatus illustrated in FIG. 8 thru FIG. 10, and the same reference numerals are affixed to corresponding members.

When the compressor is in an unload operation, the control pressure AP generated at the control valve 58 is lowered. When this control pressure AP is introduced into the control pressure chamber 80 through the through hole 69, the recessed groove 70 and the through hole 71, the piston 56 is pushed by a restoring force of the coil spring 83 and occupies a position shown in FIG. 3. Since the communication holes 89*a* and 89*b* and the communication hole 92 are thus opened, gas which is being compressed in the compression chambers 19*a* and 19*b* enters into the chamber 81 through the bypass ports 33*a* and 33*b*, the second recessed portion 87, and the communication holes 89*a* and 89*b*. On the other hand, the gas in the compression chamber which has reached the center of the spiral, viz., the gas after compression enters into the chamber 81 through the discharge port 29, the discharge hole 53, the third recessed portion 88, recessed grooves 90 and 91, and the communication hole 92. These gases join together in the chamber 81 and are discharged into the suction chamber 28. As a result, the output capacity of the compressor becomes zero.

When the compressor is in full-load operation, the control valve 58 generates a high control pressure AP. Then, the high control pressure AP enters into the control chamber 80, and presses the inner end surface of the piston 56. Thus, the piston 56 moves back against the resiliency of the coil spring 83, and occupies a position where the outer end thereof abuts against the spring shoe 82, viz., a position shown in FIG. 2. In such a state, all of the communication holes 89*a* and 89*b* and the communication hole 92 are blocked by means of the piston 56. Therefore, the gas which is compressed in the compression chambers 19*a* and 19*b* and reaches the central part of the spiral passes through the discharge port 29 and the discharge hole 53, and pushes the discharge valve 30 open so as to be discharged into the discharge cavity 31, and then discharged outside through a discharge port not shown.

When the output capacity of the compressor is reduced, a control pressure AP corresponding to a reduction rate is generated in the control valve 58. When this control pressure AP acts onto the inner end surface of the piston 56 through the control pressure chamber 80, the piston 56 comes to a standstill at a position where the pressing force by the control pressure AP and the resiliency of the coil spring 83 are equilibrated. Accordingly, only the communication holes 89*a* and 89*b* are opened while the control pressure AP is low, the gas which is being compressed in the compression chambers 19*a* and 19*b* is discharged into the suction chamber 28 by the quantity corresponding to the opening of the communication holes 89*a* and 89*b*, and the output capacity of the compressor is reduced down to 50% when the communication holes 89*a* and 89*b* are fully opened. Furthermore, when the control pressure AP is lowered, the communication hole 92 is opened, and the output capacity of the compressor becomes zero when it is fully opened. In such a manner, it is possible to have the output capacity of the compressor vary from 0% to 100% linearly.

In the above-described embodiment, a bypass passage is formed of the chamber 81, the communication holes 89*a*, 89*b* and 92 and the like of the cylinder 54, and this bypass passage is opened and closed by means of a valve mechanism consisting of the piston 56, the return spring 83, the spring shoe 82 and the like. However, these bypass passage and the valve mechanism are not limited to those that are shown, but it is a matter of course that variety of constructions and configurations may be adopted.

Further, the seal member 100 is buried in the outer circumferential surface of the capacity control block 50 in the above-described embodiment, but the seal member 100 may also be buried in the inner circumferential surface of the housing 1.

Furthermore, a fixed capacity compressor is obtainable in case no capacity control block is incorporated. In this case, the stationary scroll, the housing and the like may be used in common without special modification.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A scroll type compressor in which a stationary scroll and a revolving scroll formed by setting up spiral wraps on end plates, respectively, are made to engage with each other while shifting the angle so as to form compression chambers, said stationary scroll is installed fixedly in a housing, and said revolving scroll is made to revolve in a solar motion by means of a mechanism for driving revolution while checking rotation on its axis by a mechanism for checking rotation on its axis, thereby to move said compression chambers toward the center of the spiral while reducing volumes thereof so as to compress gas, thus discharging the compressed gas into a discharge cavity formed in said housing through a discharge port provided in the end plate of said stationary scroll, wherein the scroll type compressor comprises:

bypass ports which communicate with said compression chambers are bored in the end plate of said stationary scroll;

a capacity control block contained inside a bypass passage which has the bypass ports communicate with a suction chamber formed in said housing and a valve mechanism which opens and closes the bypass passage is formed separately from said stationary scroll, the capacity control block is engaged with said stationary scroll and installed fixedly in said housing;

a fitting recessed portion is formed on either one of the outer surface of the end plate of said stationary scroll and the side surface of said capacity control block and a fitting projected portion is formed on the other thereof;

said fitting recessed portion and said fitting projected portion are engaged with each other; and said stationary scroll and said capacity control block are installed fixedly in said housing.

2. The scroll type compressor according to claim 1, further comprising a seal member which partitions the inside of said housing into said suction chamber and said discharge cavity, the seal member being interposed between the outer circumferential surface of said capacity control block and the inner circumferential surface of said housing.

3. The scroll type compressor according to claim 1, wherein said capacity control block is made to come into close contact with the outer surface of the end plate of said stationary scroll, and is fixed by fastening with a bolt together with said stationary scroll from the outside of said housing.

4. The scroll type compressor according to claim 3, wherein a through hole for said bolt is provided in said capacity control block, a tapped hole for said bolt is provided in the end plate of said stationary scroll, and said bolt is inserted into said through hole and said taped hole from the outside of said housing so as to fix by fastening said stationary scroll and said capacity control block to said housing.

5. The scroll type compressor according to claim 4, wherein a fitting recessed portion is formed on the outer circumference of the side surface of said capacity control block, said through hole is provided at said recessed portion, a fitting projected portion is formed on the outer circumference of the outer surface of the end plate of said stationary scroll, said fitting recessed portion and said fitting projected portion are engaged with each other and fixed by fastening with said bolt from the outside of said housing.

* * * * *